US006500029B2

(12) United States Patent
Nitta

(10) Patent No.: US 6,500,029 B2
(45) Date of Patent: Dec. 31, 2002

(54) CONNECTOR EASY IN WIRE CONNECTION AND IMPROVED IN TRANSMISSION CHARACTERISTIC

(75) Inventor: Kunihiro Nitta, Inagi (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days.

(21) Appl. No.: 09/972,413

(22) Filed: Oct. 5, 2001

(65) Prior Publication Data

US 2002/0042227 A1 Apr. 11, 2002

(51) Int. Cl.[7] ..... H01R 13/648
(52) U.S. Cl. ..... 439/608
(58) Field of Search ..... 439/608, 607, 439/609, 108, 101, 701

(56) References Cited

U.S. PATENT DOCUMENTS 4,611,867 A * 9/1986 Ichimura et al. ..... 439/608
5,104,341 A * 4/1992 Gilissen et al. ..... 439/608
5,433,618 A * 7/1995 Morlion et al. ..... 439/108

* cited by examiner

*Primary Examiner*—P. Austin Bradley
*Assistant Examiner*—Ross Gushi
(74) *Attorney, Agent, or Firm*—Michael Best & Friedrich, LLC

(57) ABSTRACT

In a connector having a housing (4) and a plurality of contacts (3) held by the housing, first and second ground plates (5,9) are placed between adjacent ones of the contacts to intersect with to each other. A first contacting portion (11) is formed integral with the first ground plate and is for bringing at least one of the first and the second ground plates into contact with at least one of the contacts. The first and the second ground plates are brought into contact with to each other through a second contacting portion (12) formed integral with the second ground plate. The first contacting portion may be formed integral with the second ground plate. The second contacting portion may be formed integral with the first ground plate.

5 Claims, 6 Drawing Sheets

CONNECTOR EASY IN WIRE CONNECTION AND IMPROVED IN TRANSMISSION CHARACTERISTIC

BACKGROUND OF THE INVENTION

This invention relates to a connecting apparatus adapted to connect a high-speed signal line and, in particular, to a connector such as a straight-pin connector and a right-angle socket connector.

As a connector of a vertical-connection type for use in a connecting portion between a back board and a package board connected to the back board in a direction perpendicular thereto, use has heretofore been made of a right-angle socket mounted on the package board. The socket comprises a large number of contact modules and a large number of ground plates mounted to a front housing so as to be adapted to high-speed signal transmission. The contact modules and the ground plates are alternately arranged to be sandwiched by each other. Each of the ground plates is electrically connected to a circuit board by forming a ground connecting portion extracted or extended from the ground plate to be directly contacted with the circuit board or by cutting the ground plate to form a contact spring to be contacted with a contact through which electrical connection to the circuit board is achieved.

In the former technique, the ground connecting portions are located on the circuit board at positions between contact connecting portions. In case where the contact connecting portions are arranged at a high density, it is difficult to form a circuit pattern on the circuit board and to provide the ground connecting portions on the circuit board in view of space limitation. If the ground connecting portions are formed in an area except the neighborhood of the contact connecting portions, the number of the ground connecting portions is inevitably reduced and ground characteristics of the contacts is degraded. This results in deterioration in transmission characteristics.

In the latter technique, the ground plate is cut. In an area where the ground plate is cut, there arise various unfavorable phenomena, such as occurrence of crosstalk, variation in impedance characteristic, and reflections resulting therefrom. Thus, the transmission characteristics are degraded. Obviously, the degradation in transmission characteristics will be more serious with an increase in number of the contacts to be contacted with one ground plate.

Meanwhile, in differential transmission, a differential signal pair is transmitted through a pair of two contacts as one transmission line pair. Consideration will be made of the case where a pair of package boards are disposed on front and back surfaces of the back board with the back board interposed therebetween. As seen from a front side of a mounting surface of the back board, the package boards on the front and the back surfaces thereof are connected to the back board to be perpendicular to the back board and to be perpendicular to each other. The back board is provided with a straight-type pin connector including a number of pin contacts penetrating via through holes formed in the back board to protrude on the front and the back surfaces of the back board. The pin contacts are fitted into the right-angle socket attached to the package boards on the front and the back surfaces of the back board.

It is assumed that a pair of pin contacts forming a transmission line pair are aligned parallel to one package board on one of the front and the back surfaces of the back board. Then, the same pair of pin contacts are aligned perpendicular to the other package board on the other of the front and the back surfaces of the back board. In this event, in the right-angle socket connector on the one package board, transmission lines in the transmission line pair are equal in length to each other. On the other hand, in the right-angle socket connector on the other package board, the transmission lines in the transmission line pair are different in length from each other. This means that a pair of transmission lines in the transmission line pair are different in total length from each other. Therefore, a skew, i.e., a difference in propagation delay is produced in the single transmission line pair in the connector. As a result, transmission characteristics are degraded.

Furthermore, if a transmission line of a ground contact is substantially similar in section to that of a signal contact, crosstalk will easily occur between signal contacts arranged on both sides of the ground contact.

SUMMARY OF THE INVENTION

It is therefore an object of this invention to provide a connector which is reduced in space-related problems and which is improved in transmission characteristics.

It is another object of this invention to provide a connector in which crosstalk hardly occurs.

It is still another object of this invention to provide a right-angle socket connector of a vertical-connection type, which is capable of enhancing ground connection to be adapted to high-speed transmission by bringing a ground contact for high-speed transmission into contact with a ground plate to surround a signal contact.

According to an aspect of the present invention, there is provided a connector which comprises a housing, a plurality of contacts held by the housing to be arranged in a plane, a first ground plate placed between adjacent ones of the contacts, a second ground plate intersecting with the first ground plate and placed between adjacent ones of the contacts, a first contacting portion bringing at least one of the first and the second ground plates into contact with at least one of the contacts, and a second contacting portion bringing the first and the second ground plates into contact with to each other.

According to another aspect of the present invention, there is provided a connector assembly which comprises a back board having opposite surfaces and a plurality of connectors each according to the above-mentioned connector. The connectors are mounted on the opposite surfaces of the back board in positions such that the first ground plates are arranged in directions intersecting with each other.

According to still another aspect of the present invention, there is provided a connector which comprises a plurality of contacts, an insulator holding the contacts and having a window portion, and a ground plate facing the insulator. At least one of the contacts has a ground plate contacting portion connected to the ground plate. The ground plate contacting portion is connected with the ground plate through the window portion.

According to yet another aspect of the present invention, there is provided a multi-pole connector which comprises a plurality of connectors each according to the above-mentioned connector. The connectors are superposed one another in a condition where the ground plate extends between adjacent ones of the connectors. The multi-pole connector further comprises a front housing coupled to the connectors and a shield plate coupled to the front housing and holding the connectors in cooperation with the front housing to form an integral structure.

DESCRIPTION OF THE PREFERRED EMBODIMENTS

Figure 1:
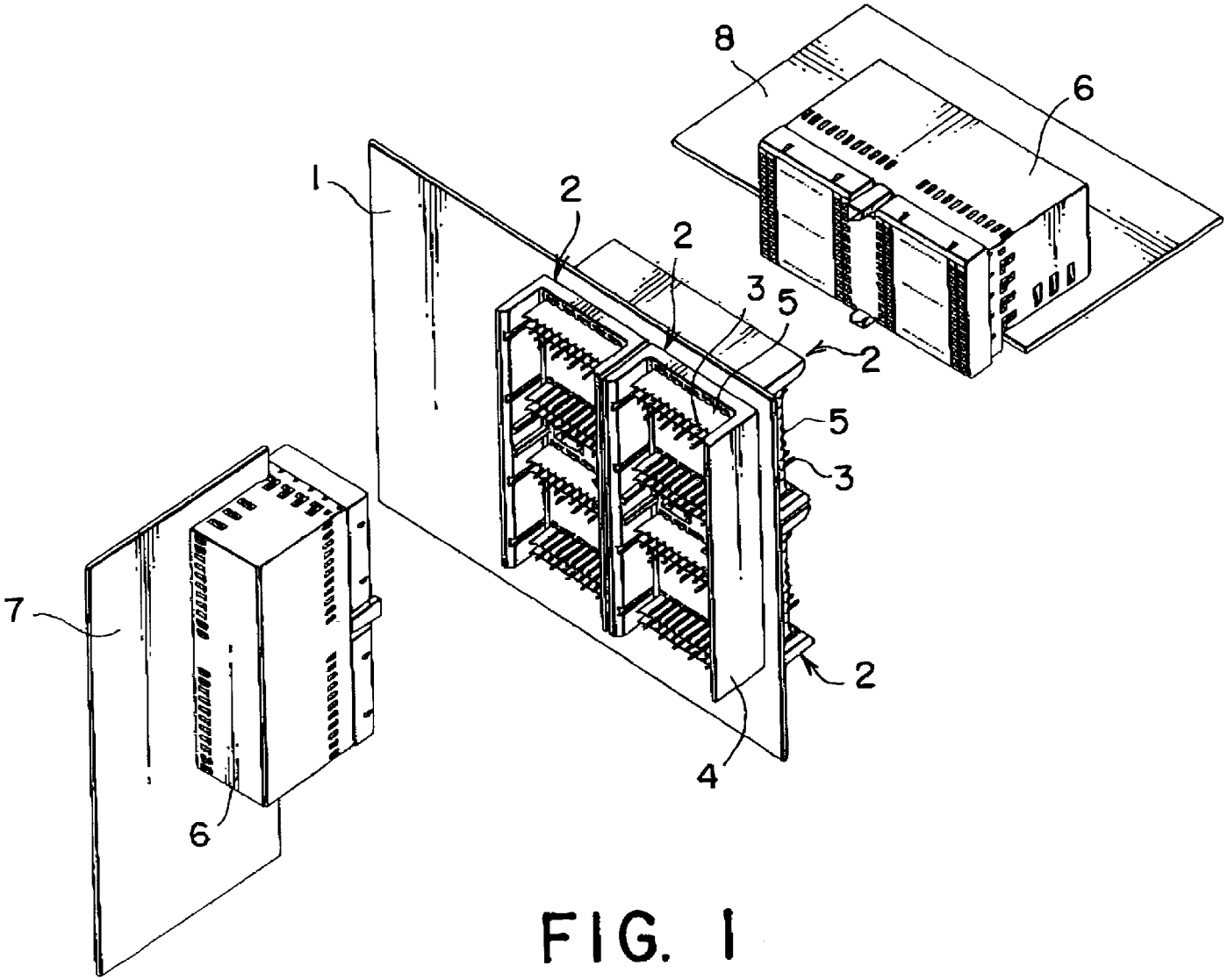
FIG. 1 is a perspective view for describing a connecting apparatus according to one embodiment of this invention in a disconnected state.

Now, this invention will be described in conjunction with a few preferred embodiment with reference to the drawing.

Referring to FIG. 1, description will be made of a connecting apparatus according to one embodiment of this invention.

As illustrated in FIG. 1, a connector assembly comprises a back board 1 standing in a vertical direction with two straight-pin connectors 2 mounted on each of opposite surfaces thereof. Each of the straight-pin connectors 2 comprises a plurality of conductive pin contacts 3 and an insulator housing 4 holding the pin contacts 3. The housing 4 has a shape of a groove. The pin contacts 3 are divided into a plurality of groups spaced from one another in a longitudinal direction of the groove of the housing 4. In each group, the pin contacts 3 are arranged in two rows parallel to each other and extending in a widthwise direction of the groove. A plurality of conductive first ground plates 5 are arranged in one-to-one correspondence to the rows of the pin contacts 3.

On one of the opposite surfaces of the back board 1, the two straight-pin connectors 2 are arranged adjacent to each other in a horizontal direction and each of the first ground plates 5 extends in the horizontal direction above each row of the pin contacts 3. On the other surface of the back board 1 opposite to the one surface, the two straight-pin connectors 2 are arranged in positions rotated by 90° with respect to those on the one surface to be adjacent to each other in a vertical direction. Each of the first ground plates 5 extends in the vertical direction on a lateral side of each row of the pin contacts 3. Thus, the straight-pin connectors 2 on the one surface and the other surface of the back board 1 are arranged so that the first ground plates 5 extend in directions intersecting with each other. The pin contacts 3 may penetrate through the back board 1 to protrude on the opposite surfaces thereof. In this event, the pin contacts 3 are used in common by the straight-pin connectors 2 on the opposite surfaces of the back board 1.

Each of the straight-pin connectors 2 is coupled and connected to a right-angle socket connector 6 as a mating connector. The right-angle socket connector 6 connected to the straight-pin connector 2 mounted on the one surface of the back board 1 is mounted on one surface of a vertical package board 7. The right-angle socket connector 6 connected to the straight-pin connector 2 mounted on the other surface of the back board 1 is mounted on one surface of a horizontal package board 8.

Figure 2:
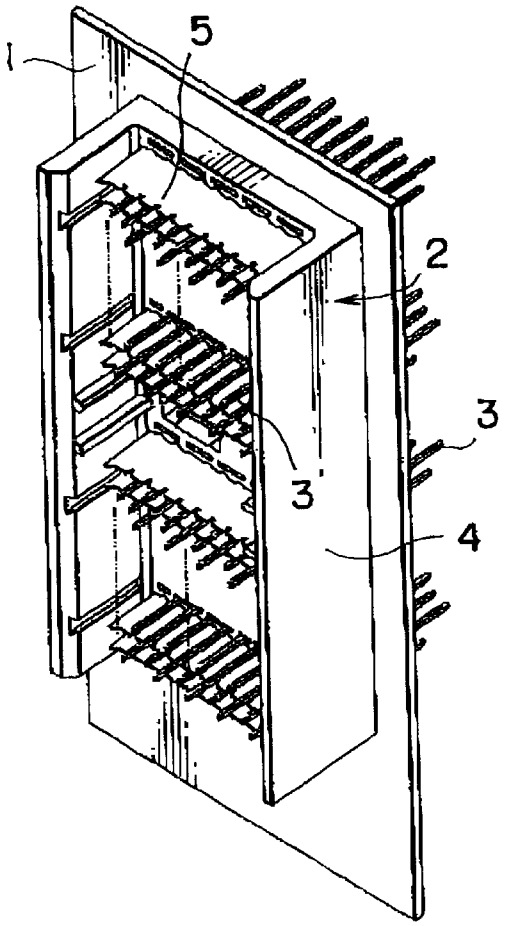
FIG. 2 is a perspective view for describing a connecting apparatus according to another embodiment of this invention in a disconnected state.
Figure 2:
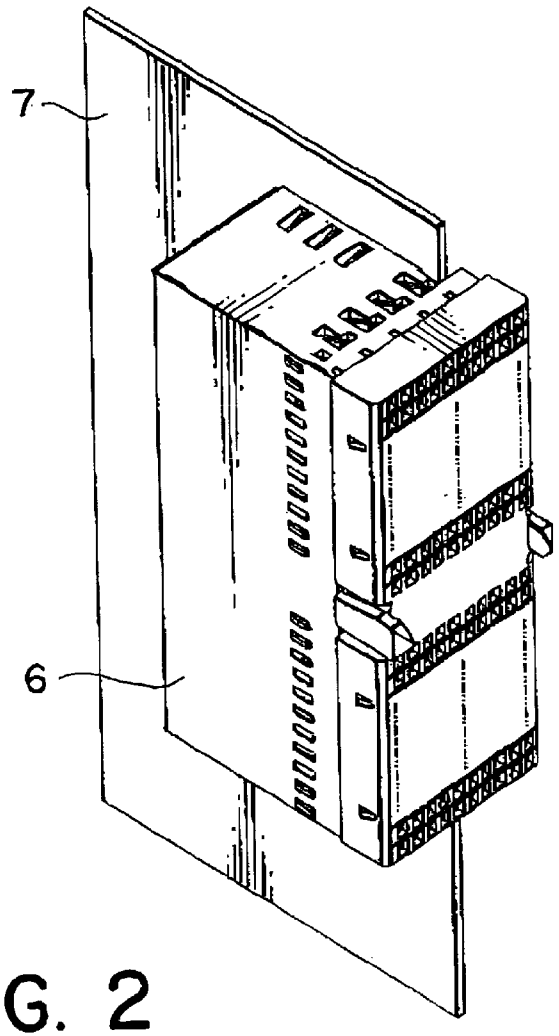

Referring to FIG. 2, description will be made of a connecting apparatus according to another embodiment of this invention. Similar parts are designated by like reference numerals and description thereof will be omitted.

As illustrated in FIG. 2, only one straight-pin connector 2 is mounted only on one surface of a back board 1. A plurality of pin contacts 3 of the straight-pin connector 2 penetrate through a housing 4 and the back board 1 to protrude on the other surface of the back board 1.

On the other hand, a right-angle socket connector 6 as a mating connector to be connected to the straight-pin connector 2 is mounted on a vertical package board 7 similar to that illustrated in FIG. 1.

Figure 3:
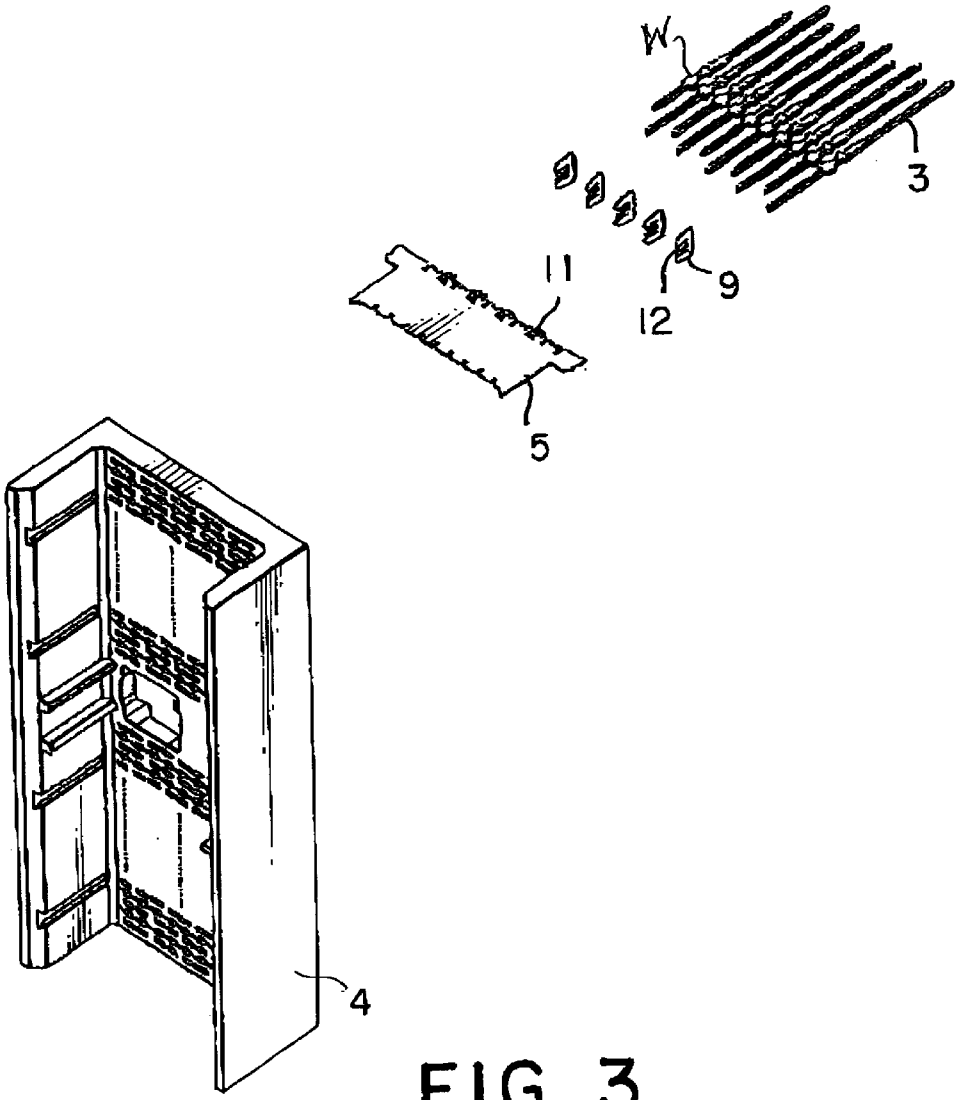
FIG. 3 is an exploded perspective view of a straight pin connector used in the connecting apparatus illustrated in FIG. 2.

Referring to FIG. 3 in addition to FIG. 2, the structure of the straight-pin connector 2 will be described in detail.

The straight-pin connector 2 comprises the pin contacts 3, the housing 4, a plurality of first ground plates 5, and a plurality of second ground plates 9. Each of the first ground plates 5 has a plurality of contacting portions 11 each of which is connected to at least one, preferably, a plurality of the pin contacts 3. Each of the second ground plates 9 extends in the vertical direction intersecting with the first ground plate 5 and is arranged between adjacent ones of the pin contacts 3. Each of the second ground plates 9 has a contacting portion 12 connected to the first ground plate 5. The pin contacts 3 are arranged along the first ground plate 5 and are alternately different in protruding length. However, the pin contacts 3 may have a same protruding length.

With the above-mentioned structure, the contacting portions 11 of the first ground plate 5 are brought into contact with some of the pin contacts 3. Therefore, it is unnecessary to extract ground connecting portions from the first ground plate 5 to the back board 1. As a consequence, it is unnecessary to form a pattern on the back board 1 and to provide the back board 1 with the ground connecting portions connected to the first ground plate 5. This removes the difficulty related to space limitation. Since at least one of the pin contacts 3 is used as a ground, ground characteristics are improved even in the vicinity of connecting portions. With an increase in number of the pin contacts used as the ground, the ground characteristics are improved further. This results in an improvement in transmission characteristics. Furthermore, since the first ground plate 5 need not be cut, the transmission characteristics are not degraded.

Figure 4:
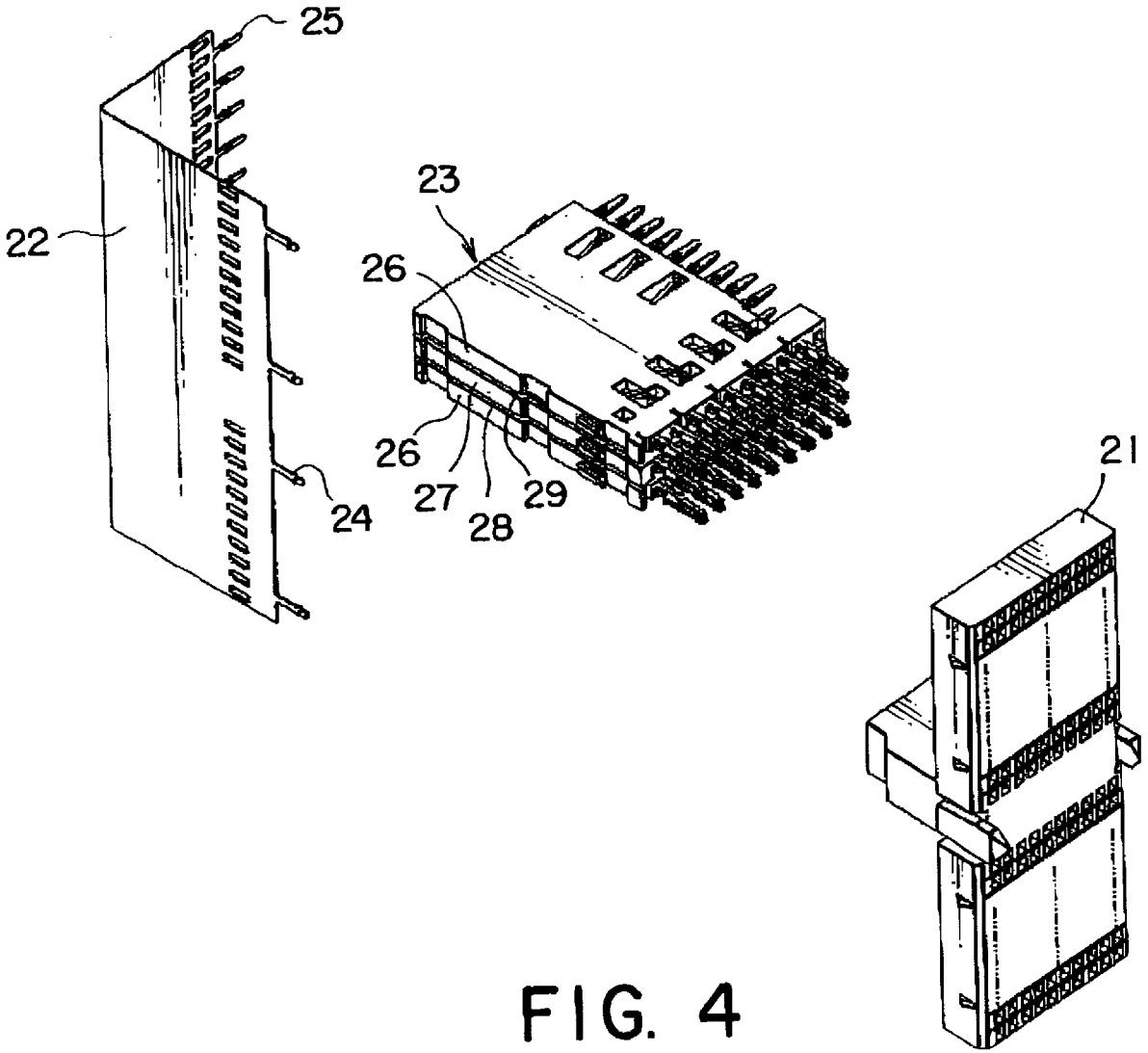
FIG. 4 is an exploded perspective view of a right-angle socket connector used in the connecting apparatus illustrated in FIG. 2.

Referring to FIG. 4 together with FIG. 2, the structure of the right-angle socket connector 6 will be described in detail.

The right-angle socket connector 6 comprises an insulating front housing 21, a conductive shield plate 22 fixed to the front housing 21, and a multilayer module assembly 23 attached between the front housing 21 and the shield plate 22. The shield plate 22 is perpendicularly bent and has one end provided with a plurality of fixing portions 24 to be fixed to the front housing 21 and the other end provided with a plurality of connecting portions 25 to be connected to the package board 7 or 8. The multilayer module assembly 23 comprises a plurality of first and second contact modules 26 and 27 alternately stacked through first and second ground plates 28 and 29 attached to upper surfaces thereof, respectively. For convenience of illustration, two first contact modules 26 and one second contact module 27 alone are illustrated in the figure. Each of the first and the second contact modules 26 and 27 serves as a multi-pin connector.

Figure 5:
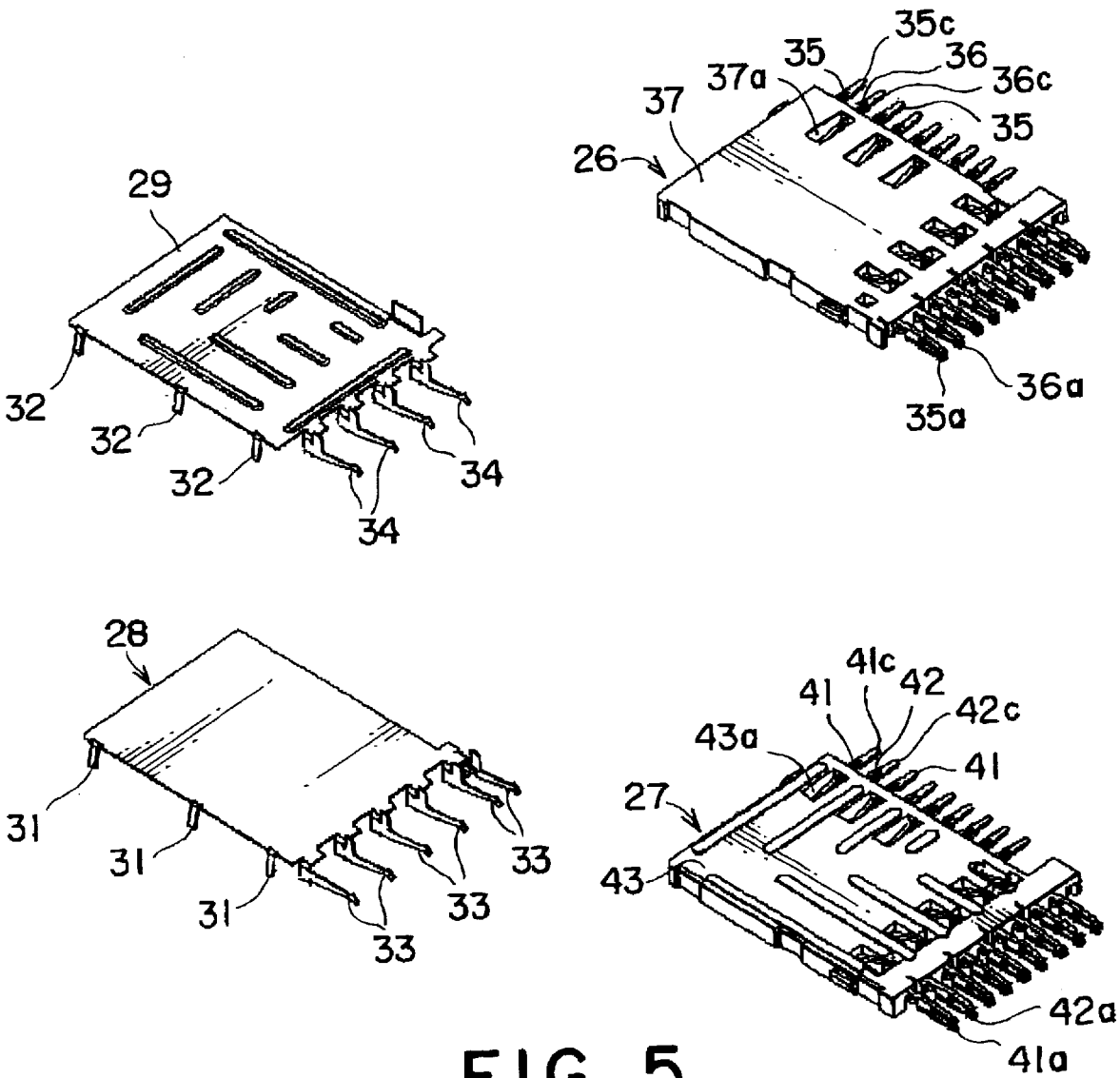
FIG. 5 is an exploded perspective view of a multilayer module assembly used in the right-angle socket connector illustrated in FIG. 4.
Figure 6:
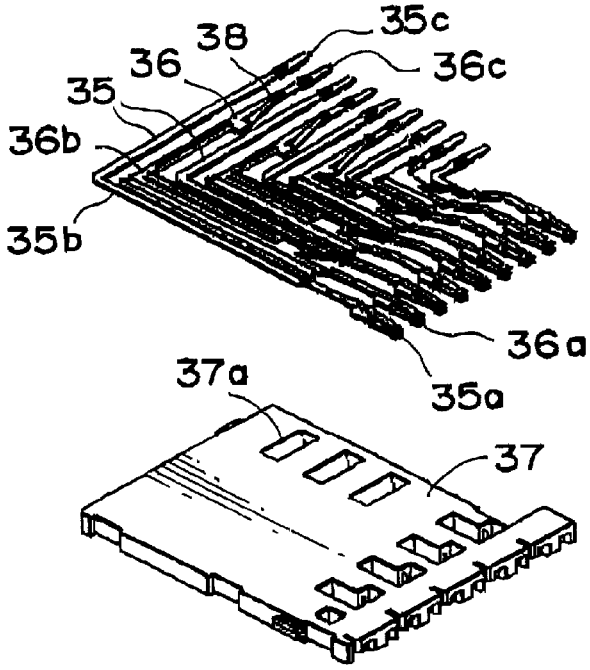
FIG. 6 is an exploded perspective view of a first contact module used in the multilayer module assembly illustrated in FIGS. 4 and 5.
Figure 7:
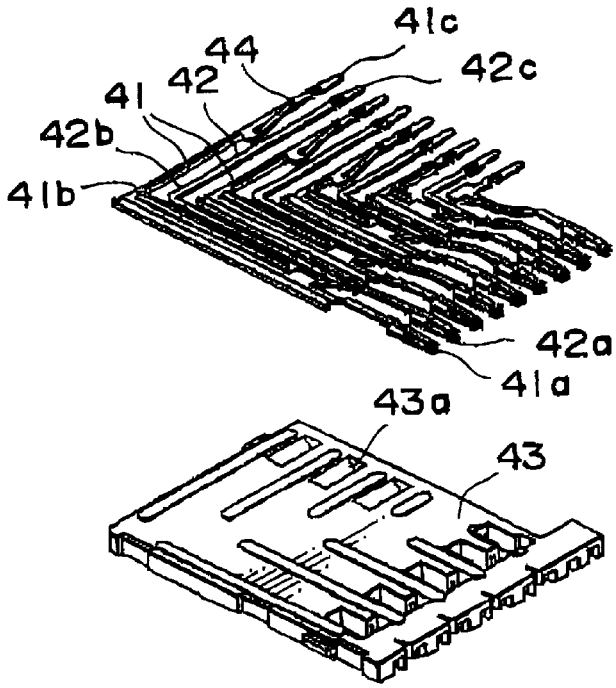
FIG. 7 is an exploded perspective view of a second contact module used in the multilayer module assembly illustrated in FIGS. 4 and 5.

Referring to FIGS. 5 through 7, the structure of the multilayer module assembly 23 will be described in detail.

Each of the first and the second ground plates 28 and 29 is conductive. The first and the second ground plates 28 and 29 have shield contacting contacting portions 33 and 34 to be contacted with the first ground plates 5, respectively.

The first contact module 26 comprises a plurality of conductive signal contacts 35 arranged in an array, a plurality of conductive ground contacts 36 interposed between every adjacent ones of the signal contacts 35, and an insulator 37 holding the contacts 35 and 36. Each of the signal contacts 35 has a socket-like contaction portion 35*a* to be contacted with the pin contact 3, an intermediate portion 35*b*, and a connecting portion 35*c* to be connected to the package board 7 or 8.

Each of the ground contacts 36 has a ground plate contacting portion 38 formed on its upper surface to be connected to the first ground plate 28. Furthermore, each ground contact 36 has a socket-like contacting portion 36*a* to be contacted with the pin contact 3, an intermediate portion 36*b*, and a connecting portion 36*c* to be connected to the package board 7 or 8. The intermediate portion 36*b* of the ground contact 36 is widened as compared with the intermediate portion 35*b* of the signal contact 35. The ground plate contacting portion 38 is formed at the intermediate portion 36*b* widened as described above.

The insulator 37 is provided with a plurality of window portions 37*a* where the ground plate contacting portions 38 are exposed. The ground plate contacting portions 38 are contacted with the first ground plate 28 through the window portions 37*a*.

The second contact module 27 comprises a plurality of conductive ground contacts 41 arranged in an array, a plurality of conductive signal contacts 42 interposed between every two adjacent ones of the ground contacts 41, and an insulator 43 holding the contacts 41 and 42. Each of the signal contacts 42 has a socket-like contacting portion 42*a* to be contacted with the pin contact 3, an intermediate portion 42*b*, and a connecting portion 42*c* to be connected to the package board 7 or 8.

Each of the ground contacts 41 has a ground plate contacting portion 44 formed on its upper surface to be connected to the second ground plate 29. Furthermore, each ground contact 41 has a socket-like contacting portion 41*a* to be contacted with the pin contact 3, an intermediate portion 41*b*, and a connecting portion 41*c* to be connected to the package board 7 or 8. The intermediate portion 41*b* of the ground contact 41 is widened as compared with the intermediate portion 42*b* of the signal contact 42. The ground plate contacting portion 44 is formed at the intermediate portion 41*b* widened as described above.

The insulator 43 is provided with a plurality of window portions 43*a* where the ground plate contacting portions 44 are exposed. The ground plate contacting portions 44 are contacted with the second ground plate 28 through the window portions 43*a*.

The intermediate portions 36*b* and 42*b* of the ground contacts 36 and 41 are widened in a direction not parallel to a line connecting the signal contacts 35 and 42. Therefore, crosstalk between the signal contacts 35 and 42 can be reduced and coupling between the ground and each of the signal contacts can be increased. Thus, the transmission characteristics can be improved.

It is possible to take a structure in which the straight-pin connectors 2 are mounted on front and back surfaces of the back board 1 to be perpendicular to each other and the pin contacts 3 protrude via the through holes of the back board 1 on the front and the back surfaces thereof to be fitted to the right-angle socket connectors on the package boards 7 and 8, respectively. In this case, if a transmission line pair is formed by a pair of the pin contacts 3 aligned oblique to each of the package boards 7 and 8, the difference in length of the transmission lines in a single transmission line pair is reversed between one and the other right-angle socket connectors on the side of the front and the back surfaces of the back board 1. Therefore, the transmission lines in each single transmission line pair are equal in total length. Therefore, a skew or a difference in propagation delay is not produced in each single transmission line pair within the connecting apparatus. As a consequence, improvement of the transmission characteristics.

What is claimed is:

1. A connector assembly comprising a back board having opposite surfaces with first and second connectors mounted on said opposite surfaces, respectively, each of said first and second connectors comprising:

a housing mounted on each of said opposite surfaces;

a plurality of contacts held by said housing and arranged in a plane;

a first ground plate between adjacent ones of said contacts;

a second ground plate intersecting with said first ground plate and located between adjacent ones of said contacts;

a first contacting portion bringing at least one of said first and second ground plates into contact with at least one of said contacts; and a second contacting portion bringing said first and said second ground plates into contact with each other, said first and second connectors being arranged in predetermined directions so that he first ground plate of said first connector intersects with the first ground plate of said second connector.

2. The connector assembly according to claim 1, wherein said connectors on the opposite surfaces of said back board use said contacts in common.

3. A connector comprising:

a plurality of contacts;

an insulator holding said contacts and having a window portion; and a ground plate facing said insulator, at least one of said contacts having a ground plate contacting portion connected to said ground plate, said ground plate contacting portion being connected with said ground plate through said window portion, each of said contacts having a contacting portion for contacting a mating contact, a wire connecting portion, and an intermediate portion between said contacting portion and said wire connecting portion, said intermediate portion of at least one of said contacts being widened as compared with said intermediate portions of the remaining contacts, said ground plate contacting portion being formed at said intermediate portion of said at least one of said contacts.

4. A multi-pole connector comprising:

a plurality of connectors each according to claim 3, said connectors being superposed one another in a condition where said ground plate extends between adjacent ones of said connectors;

a front housing coupled to said connectors; and a shield plate coupled to said front housing and holding said connectors in cooperation with said front housing to form an integral structure.

5. The multi-pole connector according to claim 4, wherein said ground plate has a shield plate contacting portion connected to said shield plate.

* * * * *

UNITED STATES PATENT AND TRADEMARK OFFICE

CERTIFICATE OF CORRECTION

PATENT NO. : 6,500,029 B2
DATED : December 31, 2002
INVENTOR(S) : Nitta

It is certified that error appears in the above-identified patent and that said Letters Patent is hereby corrected as shown below:

Title page,
Insert -- [30] Foreign Application Priority Data
Oct. 6, 2000 (JP) ..... 2000-307254 --

Column 1,
Line 30, delete "case" and insert -- cases --
Line 41, delete "arise" and insert -- arises --

Column 2,
Line 42, delete "to"

Column 3,
Line 1, delete "DRAWING" and insert -- DRAWINGS --
Line 30, delete "embodiment" and insert -- embodiments --
Line 30, delete "drawing" and insert -- drawings --

Column 5,
Line 1, after "contacting" (first occurrence" insert -- portions 31 and 32 to be contacted with the shield plate 22 and ground --
Line 8, delete "contaction" and insert -- contacting --
Line 50, delete "28" and insert -- 29 --

Column 6,
Line 7, after "consequence," insert -- there is --
Line 28, delete "he" and insert -- the --

Signed and Sealed this

Thirtieth Day of September, 2003

JAMES E. ROGAN
*Director of the United States Patent and Trademark Office*